US006895838B2

(12) United States Patent
Stahnke

(10) Patent No.: US 6,895,838 B2
(45) Date of Patent: May 24, 2005

(54) APPARATUS SYSTEM AND METHOD FOR INSTALLING A STRAINER LOCK

(76) Inventor: Mark Stahnke, 3606 S. Walker Ave., San Pedro, CA (US) 90731

( * ) Notice: Subject to any disclaimer, the term of this patent is extended or adjusted under 35 U.S.C. 154(b) by 126 days.

(21) Appl. No.: 10/624,968

(22) Filed: Jul. 22, 2003

(65) Prior Publication Data

US 2005/0016330 A1 Jan. 27, 2005

(51) Int. Cl.[7] ..... B25B 13/48

(52) U.S. Cl. ..... 81/176.15; 81/52; 81/124.2; 81/176.1; 81/176.2; 81/180.1

(58) Field of Search ..... 81/176.15, 52, 81/124.2, 176.1, 176.2, 180.1, 461

(56) References Cited

U.S. PATENT DOCUMENTS

| | | | | |
|---|---|---|---|---|
| 2,131,687 A | * | 9/1938 | Kaplan | 294/64.1 |
| 2,619,861 A | * | 12/1952 | Wanamaker | 81/176.15 |
| 3,408,924 A | * | 11/1968 | Mueller | 100/35 |
| D311,315 S | * | 10/1990 | Duke | D8/25 |
| 5,090,276 A | * | 2/1992 | Groskey | 81/436 |
| 5,542,321 A | * | 8/1996 | Fuca | 81/125.1 |
| D400,769 S | | 11/1998 | Duke | |
| 5,946,990 A | | 9/1999 | Bonacci | |
| 6,044,502 A | | 4/2000 | Fountain | |
| 6,044,732 A | | 4/2000 | Astle | |

OTHER PUBLICATIONS

Pipe Tools, Wrenches, http://www.ridgid.com/catalog/13.html, two sheets, Published at least as early as Mar. 10, 2001.

PM Perfect Match Products, Plumbing Specialty Wrenches, one sheet, Published at least as early as Mar. 10, 2001.

Modern Plumbing, one sheet, Published at least as early as Mar. 10, 2001.

* cited by examiner

*Primary Examiner*—Joseph J. Hail, III
*Assistant Examiner*—Alvin J Grant
(74) *Attorney, Agent, or Firm*—Christie, Parker & Hale, LLP

(57) ABSTRACT

A strainer lock apparatus for installing and removing a stainer in a sink or tub. A first member having a top end with a locking mechanism that may include a slot is inserted in the apertures of the strainer and rotated thus locking the first member which then hangs freely from the cross members. A second member with a threaded lock attached thereto is placed over the first member. A portion of the bottom end of the first member extends past the bottom end of the second member. An end piece is attached to the extended portion of the first member, thereby preventing the second member from falling from the first member. The second member and lock are brought into contact with the threaded surface of the top retainer section and rotated around the first member.

25 Claims, 8 Drawing Sheets

APPARATUS SYSTEM AND METHOD FOR INSTALLING A STRAINER LOCK

FIELD OF THE INVENTION

The present invention relates to strainers and the method of installing the same, and more particularly, to a strainer lock apparatus, system, and method of installing a strainer component using a first wrench that is releasably secured to a base of a strainer and a second wrench fastened to the first wrench that is rotated to secure a lock to the strainer.

DESCRIPTION OF RELATED ART

Various types of strainers have been manufactured and installed using different connectors, installation techniques and wrench devices. For example, one known technique involves an installer holding a wrench in one hand below the sink surface to tighten a nut, while holding another wrench in the other hand above the sink surface to secure a strainer component. The installer positions, maintains, and aligns the components above and below the sink, and then tightens the appropriate fasteners to secure the strainer into position. For example, in order to secure the component below the sink, the installer may use a pair of pliers in one hand to secure a component above the sink, and a wrench in the other hand to tighten another component below the sink.

An exemplary wrench configured for a known strainer includes a notched end. The ridges of the notched end are spaced and configured to mate with a lock nut below the sink. As a further example, the installer may use a strainer lock nut wrench that is designed to grip a strainer with two or more teeth at locations that are at right angles to each other to secure the top component. Further known techniques for installing strainer locks utilize a plug wrench or an all purpose wrench.

Thus, while positioning, aligning, adjusting and tightening components above and below the sink, the lock nut is eventually tightened below the sink to the strainer from both the top and bottom of the sink. A sink surface is then secured between a surface of the strainer and a face or washer of a locking ring.

Known techniques for installing a sink strainer, however, have a number of shortcomings. For example, an installer typically uses two hands in awkward positions. More specifically, one hand is below the sink, and one hand is above the sink. In this awkward position, the installer manipulates the strainer lock components and forms a seal around the strainer. Installation difficulties can arise if the installer lacks the requisite coordination and dexterity. The installer is also placed in an uncomfortable position with poor posture and ergonomics. Moreover, performing these tasks in cramped or dimly lit areas makes the installation more complicated and difficult. Thus, if the installer is uncomfortable and must move to a more comfortable position or rest, then moving his or her hand typically results in the installation process being interrupted or components being misaligned, thereby requiring the installer to begin the installation process again.

Consequently, the installer suffers fatigue as a result of manipulating components in tight, awkward and uncomfortable positions. Additionally, if these tasks are repetitive, for example, in a condominium or townhouse development, then the same uncomfortable installation procedure must be repeated multiple times, thereby enhancing fatigue. Further, once the installer secures all of the components together, they may or may not be aligned. If the components are not aligned, the installer must typically repeat all or part of the installation sequence, suffering from the same shortcomings as previously described. Moreover, the inefficient and inconvenient installation procedure results in decreased work productivity and efficiency, thereby increasing labor costs. These same problems exist when a strainer lock is replaced or repaired.

A need, therefore, exists for an apparatus, system, and method that enables a strainer to be installed in a more comfortable, effective and efficient manner than conventional systems. The improved apparatus, system, and method should enable an installer to work from one side of the sink instead of coordinating, positioning and aligning components from both sides of a sink with different tools. Further, the improved apparatus, system and method should provide flexibility by not requiring constant support, positioning or alignment of the components, thereby simplifying and shortening the installation procedure.

SUMMARY OF THE INVENTION

The present invention provides an improved apparatus and system for installing a plumbing component into a basin or tub. The plumbing component includes a top section and a bottom section. The top section includes a flange for mounting to a top surface of the basin. The top section also includes an upper threaded outer surface. The bottom section includes a lower threaded outer surface and an aperture which may include one or more retainer bars extending across the aperture to form a plurality of strainer apertures. In accordance with the present invention, the apparatus includes a first member and a second member. The first member includes a top end and a bottom end. The top has a locking mechanism configured to releasably attach the top end of the first member to the bottom section of the plumbing component, e.g., through one or more strainer apertures. The second member has a top end and a bottom end with an aperture for receiving the first member. The top end of the second member secures a lock that threadedly engages the upper threaded outer surface of the top section of the plumbing component.

In further accordance with the present invention, the locking mechanism of the first member can be configured to releasably attach to the retainer bars of the bottom section.

Also in accordance with the present invention, an end piece, such as an end cap, o-ring, flange section or a pin, can be secured to the bottom end of the first member that extends beyond said bottom end of said second member to prevent the second member from falling from the bottom end of the first member.

In further accordance with the present invention, the second member is displaceable along and rotatable around the first member. The second member can be suspended along the first member and retained by said end piece such that the second member rests upon the end piece due to gravity.

Also in accordance with the present invention, the locking mechanism can be a bayonet-type notched top end having one or more arcuate walls extending from a base of the bayonet-type notched top end. The arcuate walls have a slot therein configured to receive a retainer bar of the plumbing component. The bayonet-type notched top end can be releasably secured to the one or more retainer bars of the bottom section of the strainer by inserting the arcuate walls into one or more strainer apertures, and twisting the first member such retainer bars are inserted into one or more slots in the arcuate walls.

In further accordance with the present invention, the locking mechanism can be a retainer nut having a threaded inner diameter that can be threadedly secured to the lower threaded outer surface of the bottom section of the plumbing component.

Also in accordance with the present invention, the first member is releasably engaged to the bottom section of the plumbing component from an underside of the basin.

In further accordance with the present invention, the apparatus includes a retaining lock that can be placed around the first member to threadedly engage the lower threaded outer surface of the bottom section of the plumbing component.

In further accordance with the present invention is a method of installing a plumbing component in a basin. A first member and a second member are provided, and the second member defines an aperture configured to receive the first member therein. The top end of the first member is releasably attached to the plumbing component with a locking mechanism. A lock is installed onto a top surface of the second member. The second member is placed over the first member to engage the lock with the threaded outer surface of the bottom section. The second member with the lock is rotated to threadedly secure the basin surface between the flange and the lock.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description, reference is made to the accompanying drawings which form a part hereof, and which is shown by way of illustration specific embodiments in which the invention may be practiced. It is to be understood that other embodiments may be utilized as structural changes may be made without departing from the scope of the present invention.

One embodiment of the present invention provides a locking apparatus for installing or removing a plumbing component. More specifically, the invention can be used to attach/release a locking component to/from a base of a strainer assembly for a tub, sink, shower pan or other water receptacle or basin. The installation or removal process can be done from underneath the sink or basin without requiring an installer to hold and adjust components above and below the sink.

Figure 1A:
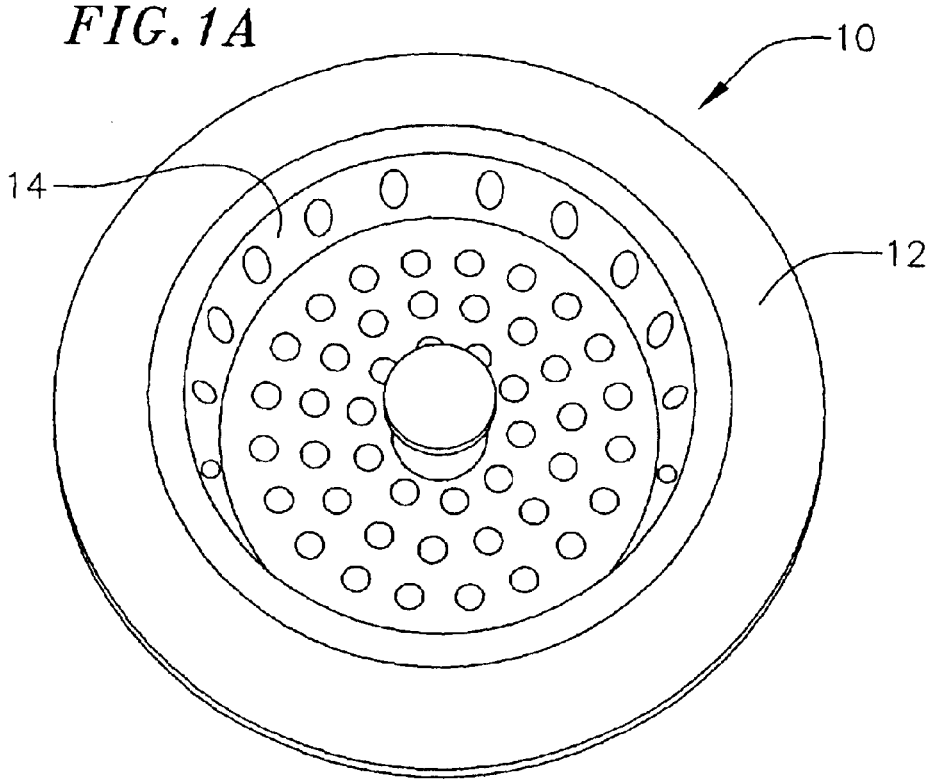
FIGS. 1A–C are respective top views of an exemplary sink basket strainer, a strainer with the basket removed showing the base with cross bars, and a side view of the base of the strainer.

For example, referring to FIG. 1A, a common sink strainer assembly 10 includes a strainer base 12 and a strainer basket 14 placed inside the base 12. The basket 14 is perforated such that water, other liquids and sufficiently small solids can pass through the apertures of the basket 14, while larger solids such as food and other materials are collected in the basket 14.

Figure 1B:
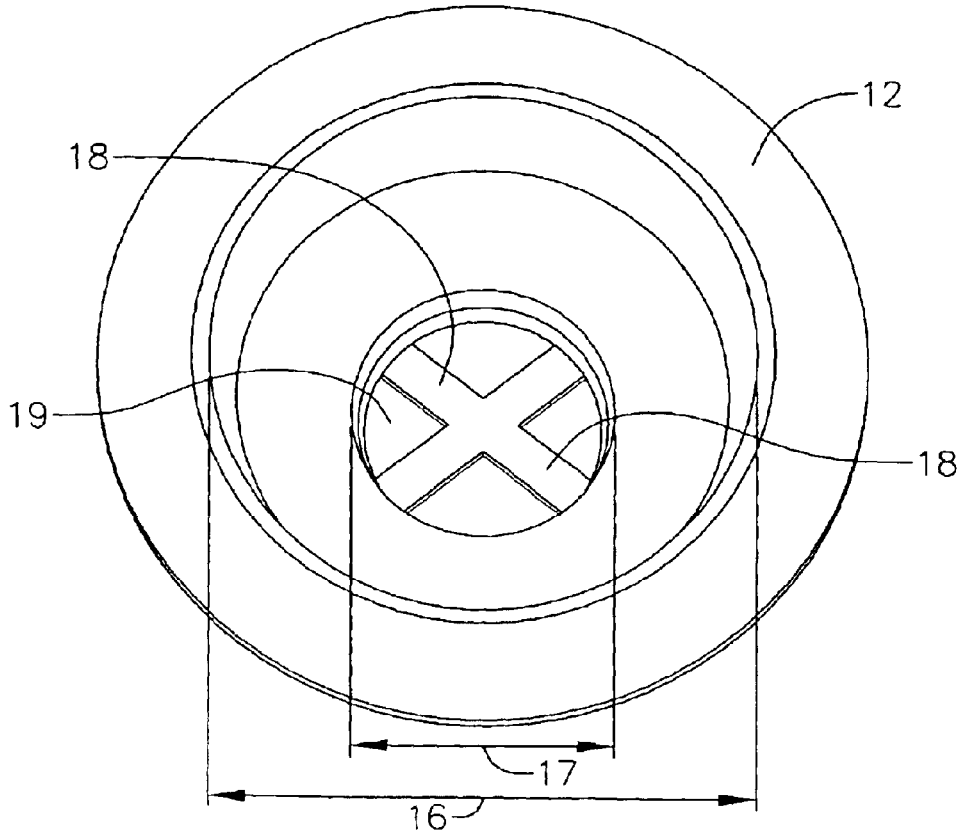

FIG. 1B illustrates the same strainer assembly 10 as FIG. 1A, but with the basket 14 removed and further illustrating the strainer base 12. This exemplary strainer base 12 narrows or tapers from a first or wider aperture 16 to a second or narrower aperture 17. Two cross bars 18 extend across opposite sides of the narrower aperture 17 at right angles relative to each other defining strainer base apertures 19. In other words, the cross bars 18 form an "X" across the lower aperture 17.

Figure 1C:
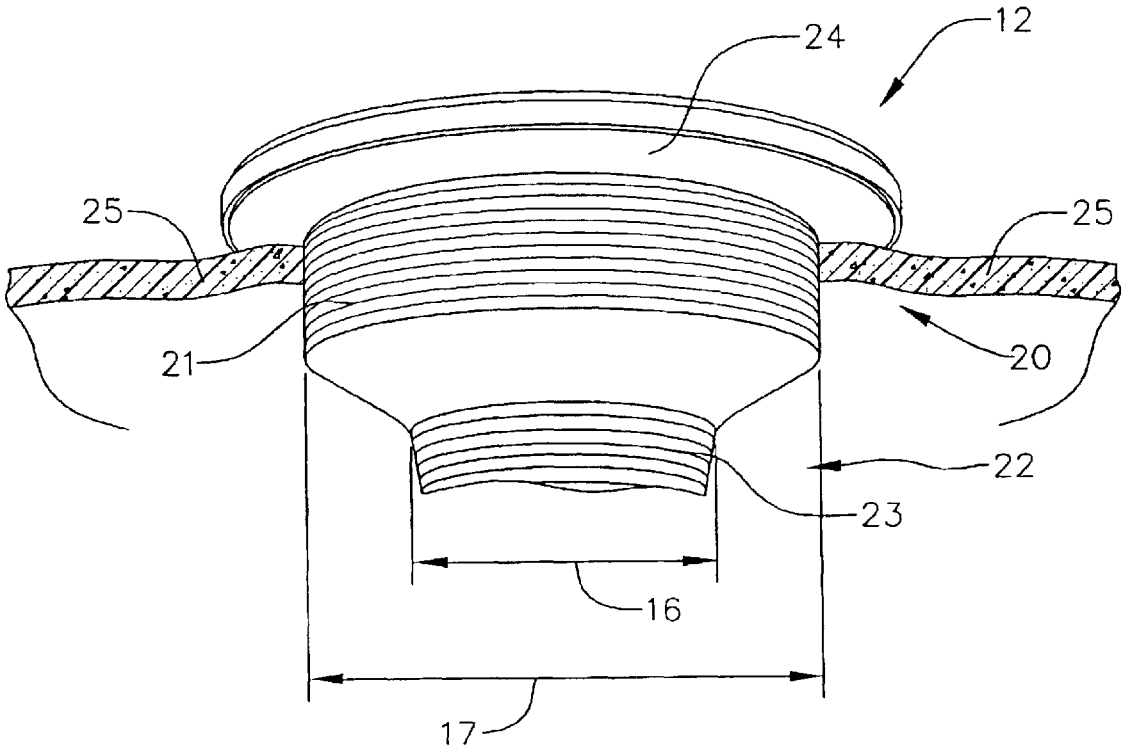

Referring to FIG. 1C, strainer base 12 includes an upper portion 20 with an upper threaded outer diameter 21 and a narrower, lower portion 22 with a lower threaded outer diameter 23. The upper portion 20 includes a mounting flange 24 that, when assembled, contacts a top surface of a basin 25 such as a sink or tub (not shown but represented by dotted line). A washer, gasket and/or plumber's putty (not shown) can be placed against the flange 24 to form a seal to improve the seal, if necessary. A nut (not shown) is threadedly secured to the threaded outer diameter 21, securing the basin surface 25 between the flange 24 and a top face of the nut.

Persons of ordinary skill in the art will recognize, however, that the present invention can be used with other base 12 and cross bar 18 configurations. For example, depending on the desired straining capabilities and/or configuration of the strainer basket 14, the lower aperture 17 can include different numbers of cross bars 18 positioned at different angles. However, the configuration of FIGS. 1A–C is shown for purposes of explanation and illustration and is representative of many strainers.

Figure 2:
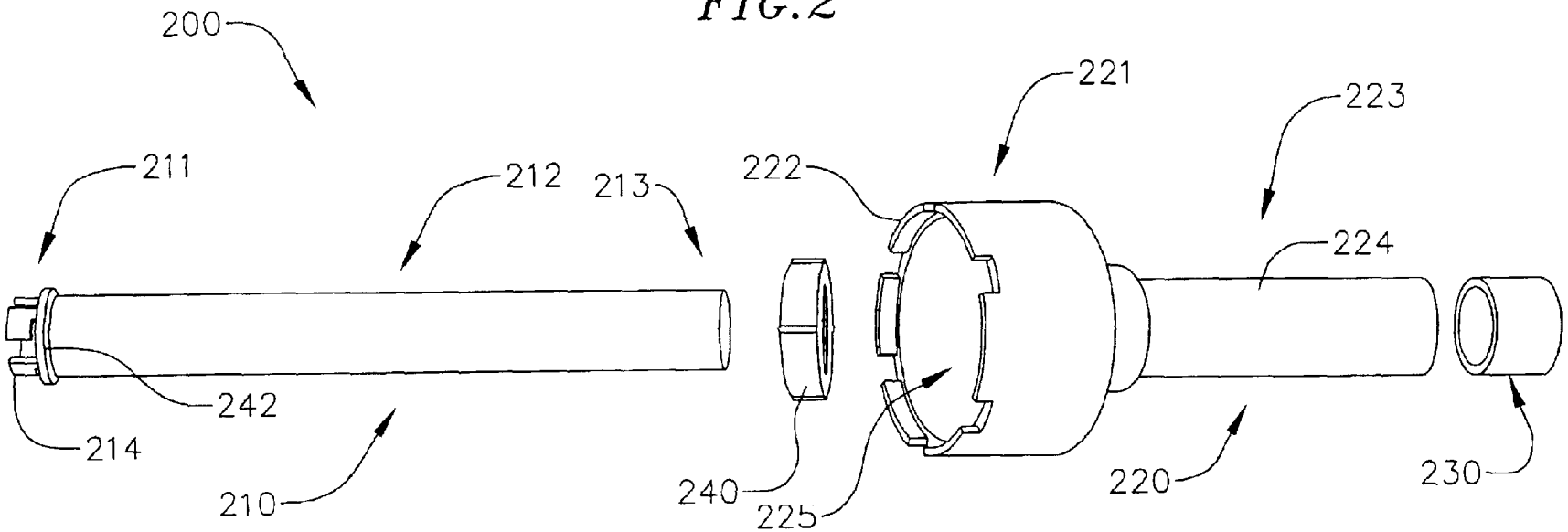
FIG. 2 is a side view of components of one example of a strainer lock apparatus.

Referring to FIG. 2, one embodiment of the present invention is generally directed to a locking assembly 200 that couples to the cross bars 18 of the strainer base 12 from an underside of a sink or basin. The assembly threadedly connects a locking nut or other component to the threaded outer diameter 21 of the strainer base 12. This embodiment is an enhancement over known tools for performing these tasks since it can be installed from an underside of the sink and can hang unsupported from the cross bars 18 or other sink component. Thus, the present invention provides an installer flexibility in installing components underneath the sink basin since he or she is not required to position and align multiple components on opposite sides of a sink with different tools. Having generally described the components of the strainer locking assembly 200, following is a more detailed description of the assembly components and the manner in which the locking assembly 200 can be used.

More specifically, an exemplary embodiment of the installation assembly 200 includes a first wrench or first member 210, a second wrench or second member 220 and an end piece 230 such as an end cap. If necessary, a retainer connector 240 such as a retainer nut can also be utilized, as will be later described.

The exemplary first wrench 210 is generally cylindrical in shape with a consistent diameter. However, the first wrench 210 is not so limited. The first wrench 210 includes a first or top end 211, a body 212 and a second or bottom end 213. The top end 211 includes a locking mechanism 214. One exemplary locking mechanism 214 is a bayonet-type or attachment notched end that secures the first wrench 210 to the cross bars 18 or other component of the strainer base 12. Thus, the first wrench 210 is permitted to hang from the cross bars 18. In an alternative embodiment, a threaded retainer nut 240 that slides over the first wrench 210 can be threadedly secured to the lower outer threaded surface 23. A rim 242 on the first wrench 210 prevents the nut 240 from sliding over the end of the first wrench. As a result, the retainer nut 240 can be used instead of, or in addition to, the bayonet-type notched end or locking mechanism 214 to releasably secure the first member 210 to the cross bars 18. Since the first wrench 210 is used to couple to the strainer base 12, it is also referred to as a "strainer wrench" 210.

Persons of ordinary skill in the art will recognize that other locking mechanisms can be utilized besides the "twist" lock mechanism previously described. For example, instead of using a series of arcuate walls with slots formed in a side of the walls or a retainer nut 240, a flexible boot (not shown) extending from the top end 211 of the first wrench 210 can be used to grasp the lower outer threaded surface 23 of the strainer base. In another alternative, the top end 211 of said first wrench 210 can be flexible and define one or more internal grooves (not shown). Thus, instead of a twisting action to releasably secure the top end 211 to the cross bars 18, a force can be applied to push the top end 211 over the one or more cross bars 18 such that the one or more cross bars 18 are secured within an interior groove of the top end 211. More specifically, the top end 211 can be flexible such that it forms around the one or more retainer bars 18. As the top end 211 is eventually pushed over the cross bars 18, they can fall into and be secured within one or more internal grooves defined by the flexible first wrench 210.

The second wrench or second member 220 includes a top portion 221 with a top end 222 (e.g., a receiving notched end) and a bottom portion 223 with a bottom end 224. In the exemplary second wrench 220 shown, the top portion 221 is wider and shorter than the bottom portion 223. The wider top portion 221 is configured for attachment or insertion of a lock (not shown in FIG. 2) into the receiving slotted end 222. The narrower bottom portion 223 is configured to receive the first wrench 210 therein such that a portion of the bottom end 213 of the first wrench 210 extends beyond the bottom end 223 of the second wrench 220. An end piece 230 such as an end cap or end flange can then be attached to the bottom end 213 of the first wrench 210 that extends beyond the bottom end 223 of the second wrench 220.

The first and second portions 221, 223 of the second wrench 220 define an aperture 225 into which the first wrench 210 can be inserted. Specifically, the inner diameter of the interior of both portions 221, 223 accommodates the outer diameter of the first wrench 210. As a result, the second wrench 220 can be installed over the bottom end 213 of the first wrench 210. As the second wrench 220 is displaced over the first wrench 210, the bottom end 213 of the first wrench 210 can extend out from the bottom end 224 of the second wrench 220.

The receiving notched top end 222 is used to position or attach a lock (not shown) that can be secured to the strainer base 12. One exemplary lock is a circular or ring lock nut with a threaded inner diameter designed to threadedly engage a corresponding threaded surface of the strainer base 12.

The end piece 230 is attached to the bottom end 213 of the first wrench 210 that extends beyond the bottom end 223 of the second wrench 220. The end piece 230 serves as a "stopper" that limits the movement of the second wrench 220 and prevents the second wrench 220 from falling to the ground or otherwise releasing from the bottom end 213 of the first wrench 210. Thus, the end piece 230, in effect, serves to suspend the first and second wrenches 210, 220 together, while permitting the wrenches 210, 220 to be displaced and rotated relative to each other. A spring mechanism or a magnet mechanism may also be used between the second wrench and the end piece to bias the second wrench away from the end piece.

Figure 3:
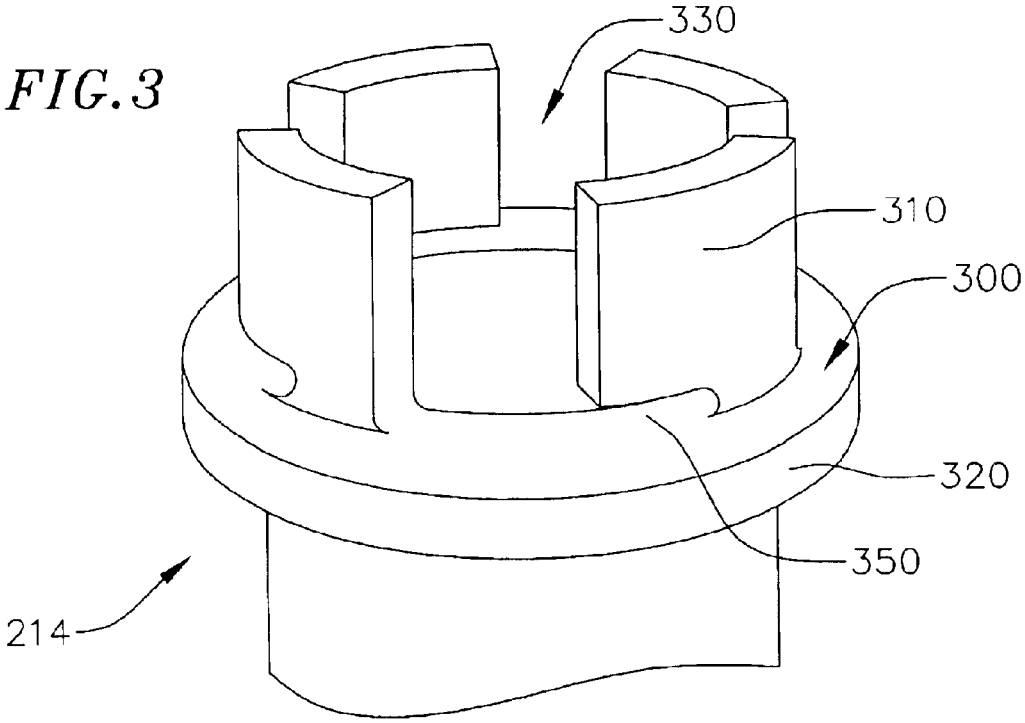
FIG. 3 is a perspective view of a locking mechanism of a first wrench of the strainer lock apparatus having a notched end.

Turning now to FIG. 3, a more detailed view of one embodiment of the locking mechanism 214 of the first wrench 210 is illustrated. One exemplary locking mechanism 214 is a bayonet-type notched end 300 that includes one or more arcuate ridges or walls 310 extending from a base 320 and forming apertures 330 adjacent to ridges 310. A horizontal slot 350 is formed in a side of one or more ridges 310.

With this configuration, the arcuate ridges 310 can be inserted through the apertures 19 formed by the cross bars 18 such that the horizontal slot 350 is aligned with the cross bars 18. The first wrench 210 can then be rotated or twisted such that the cross bars 18 are inserted into the slots 350 of the arcuate ridges 310 and secured or attached therein. The first wrench 210 can then hang from the cross bars 18 without the installer's assistance since the top end 211 of the first wrench 210 is releasably secured to the cross bars 18.

The top end 211 of the first wrench 210 can be rotated in the opposite direction to release the locking mechanism 214 from the cross bars 18, thereby disengaging the cross bars 18 from the slots 350. Thus, the locking mechanism 214 can be released or secured by twisting or rotating the first wrench 210. Of course, the slot 350/cross bar 18 configuration can be designed such that twisting the first wrench 210 in clockwise or counterclockwise directions secures the cross bars 18 within the slots 350 of the ridges 310 or release the locking mechanism 214 from the cross bars 18.

Figure 4:
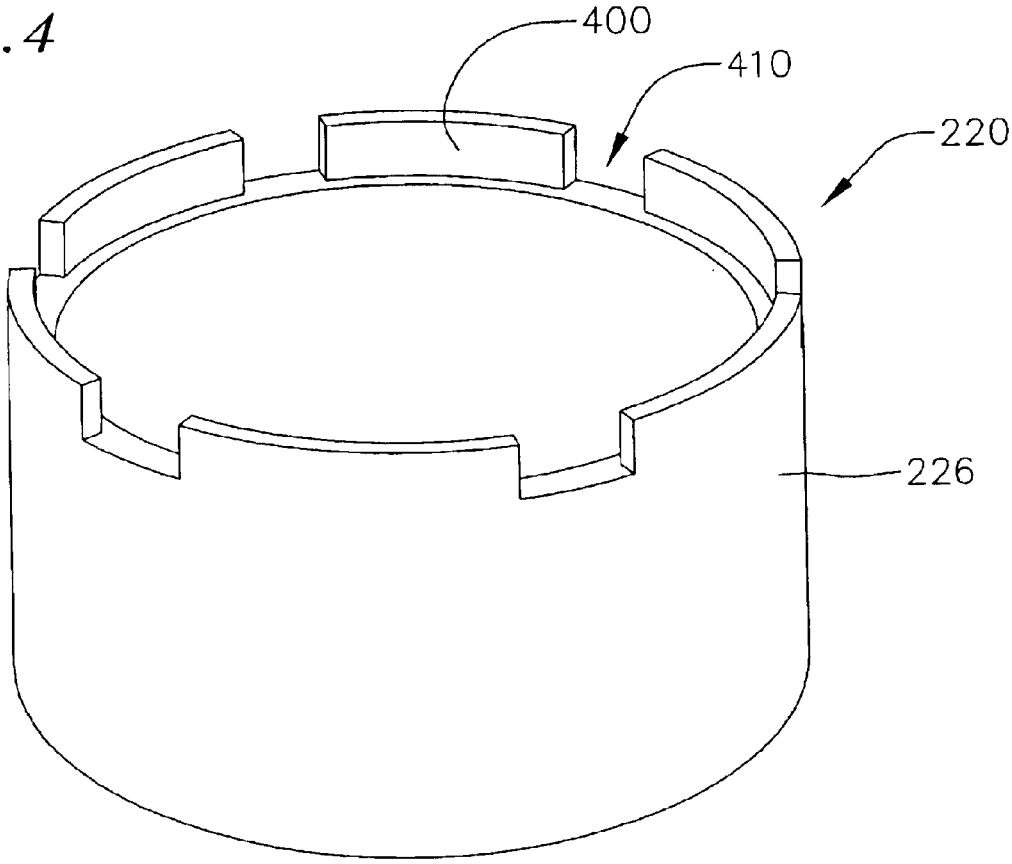
FIG. 4 is a perspective view of a support mechanism with a notched end of a second or lock wrench of the strainer lock apparatus.

Referring to FIG. 4, the second wrench 220, i.e., the "lock wrench," has a top receiving slotted end 226. The top receiving end 226 has a plurality of ridges 400 and apertures or slots 410 defined thereby. However, unlike the bayonet-type locking mechanism 214 of the first wrench 210 illustrated in FIG. 3, the ridges 410 do not have slots formed therein. Instead, a lock device, such as a threaded lock or ring nut (not shown), can be placed or positioned in the notched top end 226, being laterally secured via the ridges 400.

Figure 5:
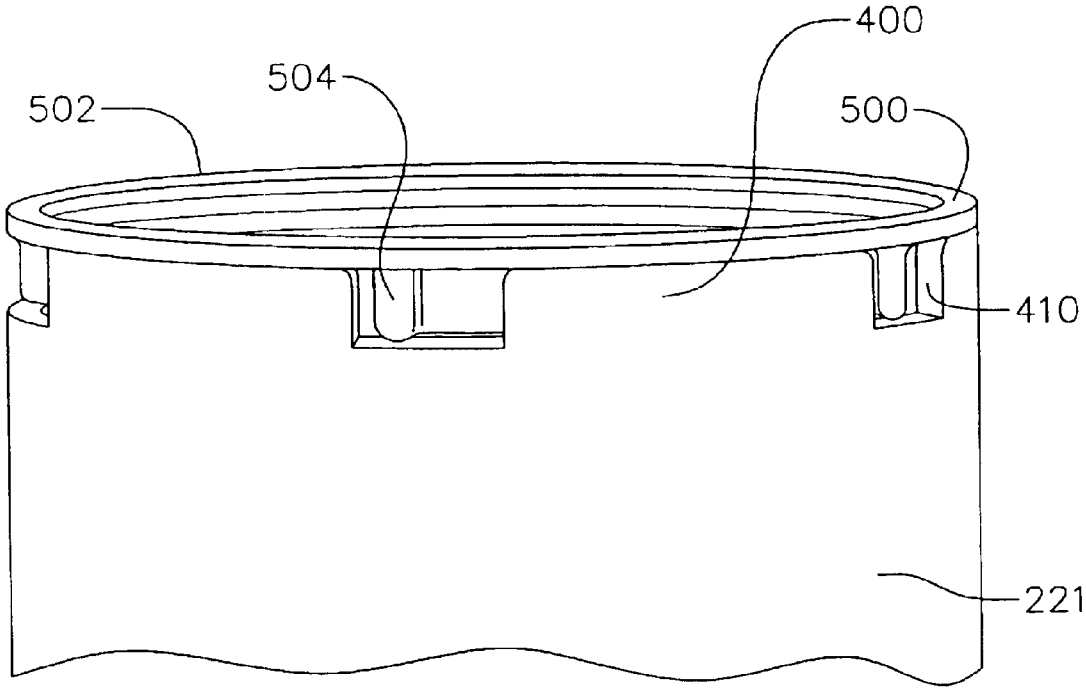
FIG. 5 is a side view of a lock nut attached to a top face of the second or lock wrench.

For example, referring to FIG. 5, one exemplary lock nut 500 is a circular brass nut with a threaded inner diameter 502. The nut 500 can have bottom ridges 504 that correspond to the apertures 410 of the top end 226 and are positioned and laterally secured by the ridges 400. The lock 500 is positioned on top of the notched end 226 of the second wrench 220 such that the inner threaded diameter 502 can be threadedly secured to the threaded outer diameter 21 of the strainer base 12. Persons of ordinary skill in the art will recognize that other attachment or connection techniques can be utilized to position or releasably secure the lock 500 to the second wrench 220, e.g., the lock nut may be in the form of a hex type nut with the end of the second wrench having a matching socket. Those persons of ordinary skill in the art will recognize that other securing techniques can be utilized to position or releasably secure the lock 500 to the second wrench 220.

The end piece 230 is secured to the bottom end 213 of the first wrench 210 extending beyond the bottom end 224 of the second wrench 220. The end piece 230 is designed to have a sufficient width or sufficiently wide flanges such that the second wrench 220 can be displaced along the first wrench 210 while being retained from further downward movement by the end cap 230. Exemplary end pieces include an "end" cap as illustrated in FIG. 2, a flange section, an o-ring installed around the bottom end of the first wrench, a pin extending from one or more sides of the bottom end of the first wrench, or other components that can be secured to the bottom end of the first wrench and limit the movement of the second wrench. Accordingly, the end cap illustrated in FIG. 2 is merely illustrative of various end pieces that can be utilized to effectively suspend the first wrench 210 and the end piece 230 attached to the bottom end of the first wrench 210, while the second wrench 220 is displaceable and rotatable at the same time.

Figure 6:
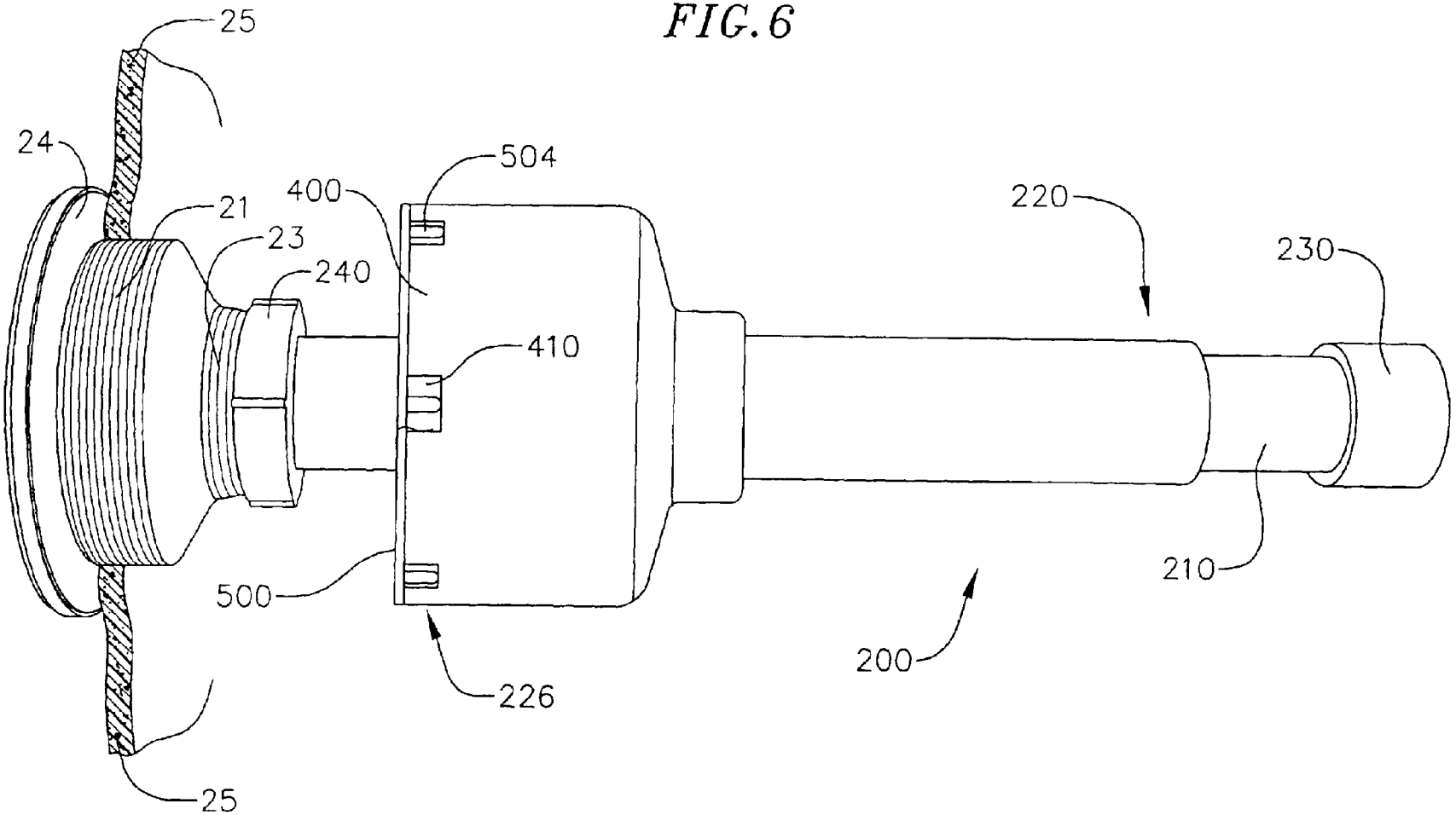
FIG. 6 is a side view of an assembly with the installed components in relation to the strainer base.

FIG. 6 illustrates an exemplary assembled lock apparatus 200 including the previously described components in relation to the strainer base 12. Specifically, FIG. 6 illustrates the alternative embodiment that uses a retainer nut 240 to threadedly secure to the threaded outer diameter 23 of the strainer base 12. The retainer nut 240 has a threaded inner diameter or surface and can be placed and displaced over the first wrench to contact the lower threaded portion 23. The nut 240 can be threadedly secured to the threaded outer diameter 23 to releasably secure the top portion 211 of the first wrench 210 to the strainer base 12. The slotted nut or ring lock 500, in turn, is attached to the receiving notched end 222 of the second wrench 220. The first strainer wrench 210 may or may not include the bayonet-type locking mechanism to be releasably secured to the cross bars 18 of the apertures 19 defined in the lower threaded outer diameter 22 of the strainer base 12.

The entire assembly 200 can hang from the cross bars 18 of the base 12 underneath the sink since the components are directly or indirectly fastened or secured to the cross bars 18 through the locking mechanism 214 of the first wrench 210. As a result, the installer can lift the second wrench 220 such that the lock threads 502 come into contact with the corresponding upper threaded outer diameter 21 of the retainer base 12, and rotate the second wrench 220 to threadedly secure these components. However, if the installer stops rotating the assembly 200, the assembly 200 can remain suspended from the cross bars 18, assuming the locking components are sufficiently engaged and the end piece 230 is installed on the bottom end 213 of the first wrench 210 to prevent the second wrench 220 from falling from the first wrench 210. As a result, the installer can rest and continue rotating the second wrench 220 to continue securing the lock at any time.

Further, the assembly 200 is "self aligning" since the components are aligned in a linear arrangement due to gravity's downward forces. The present invention enables the installer to install strainer components with flexibility and improved ergonomics since aligning and tightening components above and below a sink or tub basin with different tools is no longer necessary. Rather, the strainer and lock components can be installed and aligned from underneath the sink. In addition, if plumber's putty is used between the strainer flange and the sink, the tool will compress the putty due to its weight or by the application of additional force by an installer who pulls down on the first wrench while tightening the lock nut with the second wrench. Having described the components of the apparatus and system for installing a strainer or other similarly configured plumbing component, this specification now describes the method and steps for installing and removing the same.

Figure 7A:
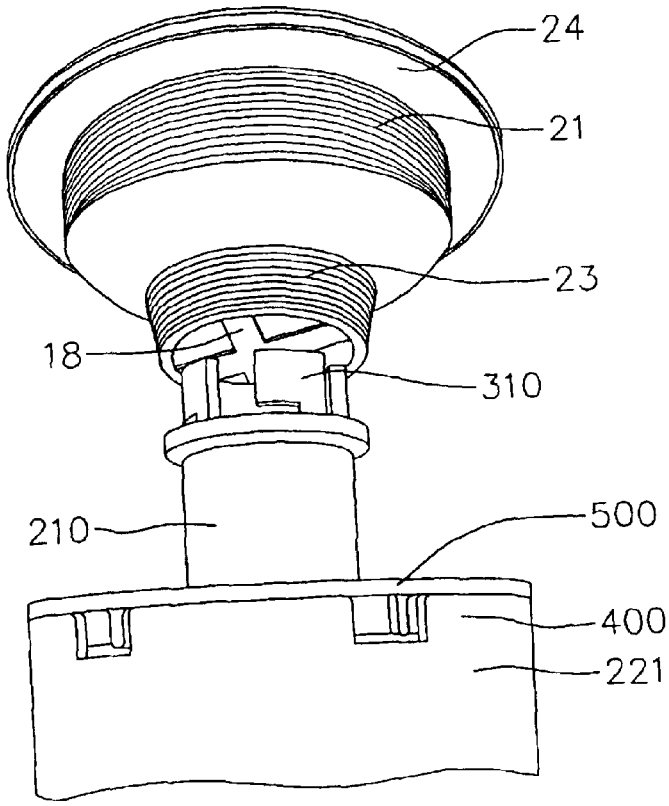
FIGS. 7A–B are side and top views of the process of securing the locking mechanism to cross bars of the strainer base.
Figure 7B:
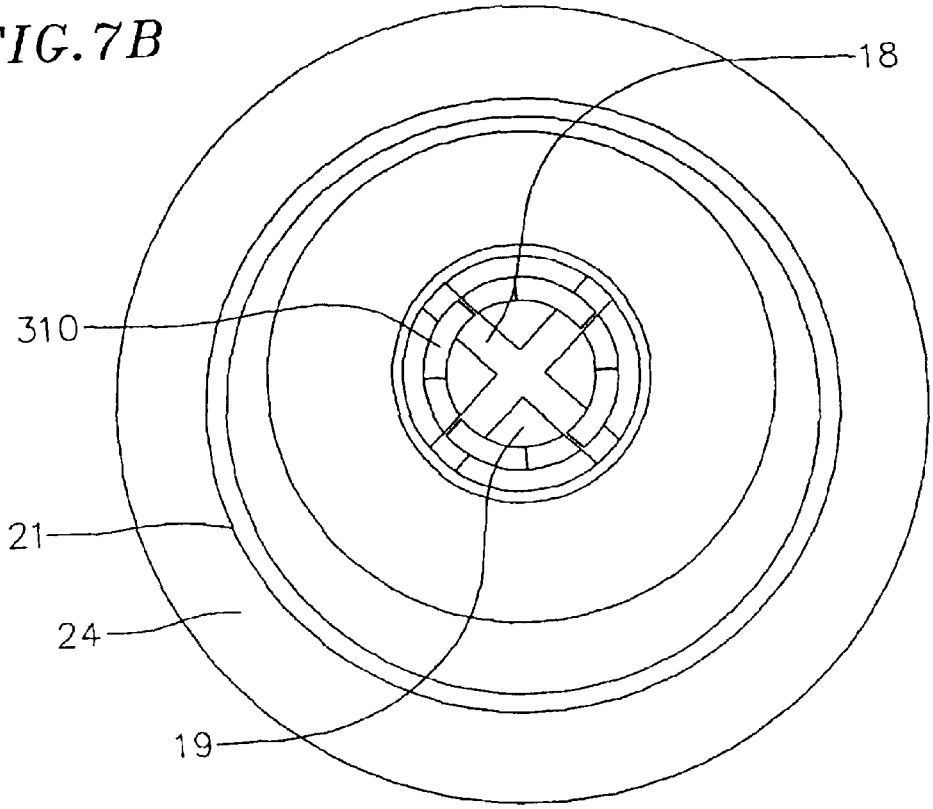

A first wrench or member and a second wrench or member, as previously described, are provided. A lock nut, e.g., a brass ring nut or other fitting, is inserted into the receiving slotted end of the second wrench, as illustrated in FIG. 5. Then, the first wrench is fastened to the cross bars or other component of the strainer, as illustrated in FIGS. 7A–B. FIG. 7A illustrates the first wrench ready to be secured to the cross bars using the embodiment directed to the bayonet-type locking mechanism. FIG. 7B illustrates the first wrench releasably coupled to the cross bars.

Figure 8A:
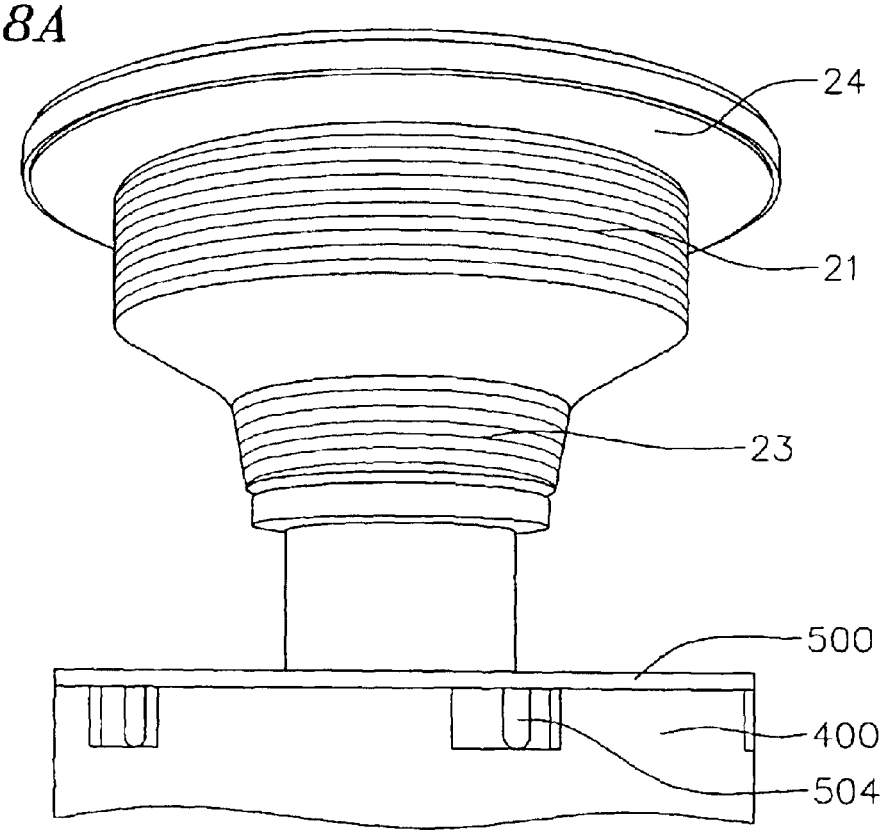
FIGS. 8A–B are side views of the strainer base and positions of the lock nut for threadedly engaging a surface of the strainer base.
Figure 8B:
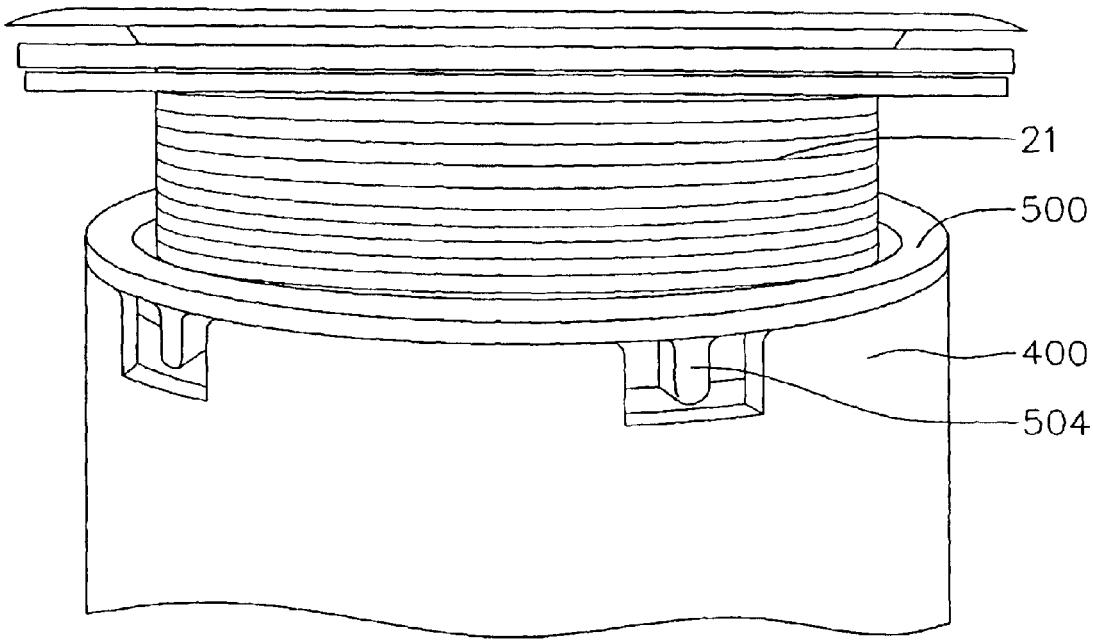

More specifically, with reference to FIGS. 8A–B, in the embodiment directed to the bayonet-type notched end, the notched end of the first wrench is inserted into the apertures of the strainer base. Then, the wrench is rotated or twisted. As a result, the cross bars are inserted into and releasably secured within the recess(es) or horizontal slot(s) formed in one or more ridges of the bayonet-type notched end. Thus, the locking mechanism of the first wrench is secured to the cross bars, resulting in the ridges extending from the base being positioned above the cross bars.

The alternative retainer nut illustrated in FIG. 6 can be used instead of, or in addition to, the bayonet-type locking mechanism. Thus, in the alternative embodiment, the threaded retainer nut or connector is installed along the first wrench body and secured to the lower outer threaded diameter of the strainer base. The top end of the first member can also be releasably secured to the cross bars, if desired.

Next, the second wrench is placed over the first wrench and displaced up the first wrench. As a result, the bottom end of the first wrench extends beyond the bottom end of the second wrench.

The end piece can be installed on the bottom end of the first wrench extending beyond the bottom end of the second wrench to retain and limit vertical movement of the second wrench and prevent it from sliding off of the bottom of the first wrench. The second wrench is displaceable and rotatable along the first wrench.

Continuing, the installer raises the second wrench and ring lock or lock nut attached thereto in contact with the outer threaded surface of the upper portion of the strainer base. Thus, the threaded surface of the outer portion of the base and the threaded inner surface of the ring lock are in contact with each other and ready to be threadedly engaged, as generally illustrated in FIGS. 8A–B. Specifically, the second wrench is lifted up the first wrench to move the first wrench/nut from the position shown in FIG. 8A to the position shown in FIG. 8B.

Next, the installer rotates the second wrench/lock to threadedly connect the ring lock and the upper outer threaded diameter of the retainer. The installer twists or rotates the second wrench/lock until the lock is installed. As a result, the basin surface is secured between the flange of the strainer base and a face of the ring lock on the underside of the basin. This is generally illustrated in FIG. 6 (the basin surface 25 secured between the flange 24 of the strainer and a face of the lock 500).

If during the installation process the installer stops rotating the assembly or lets go of the assembly, the second wrench remains suspended and will not fall from the bottom end of the first wrench, assuming the threaded portions have been sufficiently engaged and the end piece is installed. As a result, the installer can position himself or herself in a more comfortable position, without straining his or her hands or positioning or aligning components and without repeating past installation steps.

Then, once the strainer base is installed, the second wrench is moved downward or released, thereby disengaging the ring lock.

With the bayonet-type locking mechanism, the first wrench is released from the cross bars by rotating the first wrench in the opposite direction than the installation direction. As a result, the cross bars of the strainer base are removed or disengaged from the horizontal slots formed within the ridges of the locking mechanism of the first wrench. Thus, the two wrenches can remain releasably connected to each other after the locking mechanism is released from the cross bars. Alternatively, the end piece can be removed, thereby releasing the second wrench from the first wrench, and the first wrench can be twisted or rotated in the opposite direction such that the cross bars are removed from the slots in the ridges. Further, in the alternative embodiment of the locking mechanism directed to a retainer nut, the retainer nut can be twisted or rotated to threadedly release the nut and first wrench from the lower outer threaded diameter of the strainer, thereby releasing the first wrench from the strainer base.

Persons of ordinary skill in the art will recognize that the above apparatus, system and method can be implemented using different locking mechanisms to secure the first wrench to the cross bars. Moreover, persons of ordinary skill will recognize that different thread configurations of the plumbing component, ring lock, and retaining nut can also be utilized. Thus, while the preferred embodiment is described as utilizing a notched-end design for the locking mechanism of the first wrench and the ring nut attachment to the second wrench, persons skilled in the art will recognize that other similar mechanisms can also be utilized.

What is claimed is:

1. An apparatus for installing a plumbing component into a basin, the plumbing component including a top section and a bottom section, the top section having a flange for mounting to a top surface of the basin and an upper threaded outer surface, the bottom section having a lower threaded outer surface and defining an aperture, the apparatus comprising:

a first member having a top end and a bottom end, said top end having a locking mechanism configured to releasably attach said top end of said first member to the bottom section of the plumbing component; and a second member having a top end and a bottom end and defining an aperture for receiving said first member therein, said top end of said second member being configured to secure a lock that threadedly engages the upper threaded outer surface of the top section of the plumbing component.

2. The apparatus of claim 1, wherein said locking mechanism of said first member is configured to releasably attach to one or more retainer bars extending across the aperature of the bottom section.

3. The apparatus of claim 1, further comprising an end piece configured to be secured to said bottom end of said first member that extends beyond said bottom end of said second member, said end piece preventing said second member from falling from said bottom end of said first member.

4. The apparatus of claim 3, wherein said end piece is an end cap, an o-ring, a flange section, or a pin.

5. The apparatus of claim 1, wherein said second member is displaceable along said first member.

6. The apparatus of claim 1, wherein said second member is rotatable around said first member.

7. The apparatus of claim 1, wherein said locking mechanism comprises a bayonet-type notched top end having one or more arcuate walls extending from a base of said bayonet-type notched top end, said one or more arcuate walls having a slot therein configured to receive a retainer bar of the plumbing component.

8. The apparatus of claim 1, wherein said locking mechanism comprises a retainer nut having a threaded inner diameter, said threaded inner diameter being threadedly secured to the lower threaded outer surface of the bottom section of the plumbing component.

9. The apparatus of claim 1, wherein said locking mechanism comprises a flexible rubber attachment, said flexible rubber attachment configured to be placed over the lower threaded outer surface thereby releasably attaching said first member to the bottom section of the plumbing component.

10. The apparatus of claim 1, wherein said top end of said second member comprises a slotted top end having one or more arcuate walls extending from a base of said slotted top end of said second member and defining one or more adjacent apertures, wherein said lock is configured to be inserted into said slotted top end.

11. The apparatus of claim 1, wherein said top portion of said second member has a larger diameter than said bottom portion of said second member, said larger diameter being configured to secure said lock that threadedly engages the top threaded outer surface of the plumbing component, said bottom portion diameter being configured to receive said bottom end of said first member.

12. The apparatus of claim 1, wherein said second member is rotated to threadedly secure said lock supported by said second member to the outer threaded surface of the top section of the plumbing component.

13. The apparatus of claim 1, wherein the plumbing component comprises a strainer.

14. The apparatus of claim 1, wherein the basin comprises a sink or tub.

15. A system for installing and removing a plumbing component having a top section with a flange for mounting to a top surface of a basin and an upper threaded outer surface, a bottom section with a lower threaded outer surface and defining an aperture with one or more retainer bars extending across the aperture to define a plurality of strainer apertures, the system comprising:

a first member having a top end and a bottom end, said top end having a locking mechanism configured to releasably attach said top end of the first member to the plumbing component;

a second member having a top end and a bottom end and defining an aperture for receiving said first member therein, said top end of said second member being configured to secure a lock that threadedly engages the upper threaded outer surface of the top section of the plumbing component, a lock positioned within said top end of said second member, said lock having a face for mounting to a bottom surface of the sink and configured for threadedly engaging the outer threaded surface of the top section of the plumbing component; and an end piece secured to said bottom end of said first member that extends beyond said bottom end of said second member, said end piece preventing said second member from falling off said bottom end of said first member, wherein said second member and said lock received therein are rotatable around said first member to threadedly secure the basin between the flange of the plumbing component and said mounting face of said lock.

16. The system of claim 15, wherein said locking mechanism comprises a bayonet-type notched end having one or more arcuate walls extending from a base of said bayonet-type notched top end and defining one or more adjacent apertures, said one or more arcuate walls having a slot therein configured to receive a retainer bar of the plumbing component.

17. The system of claim 16, wherein said bayonet-type notched top end is releasably attached to the one or more retainer bars by twisting said first member such that the one or more retainer bars are inserted into and secured within the one or more slots of said one or more arcuate walls.

18. The system of claim 15, wherein said locking mechanism comprises a retainer nut, said retainer nut having an inner threaded diameter configured for releasably attaching to the outer threaded surface of the bottom section of the plumbing component.

19. The system of claim 15, wherein said second member is displaceable along said first member and retained from falling from said bottom end of said second member by said end piece.

20. The system of claim 15, said top end of said second member defining one or more recesses, wherein said lock includes one or more ridges configured for insertion into said one or more recesses.

21. The system of claim 15, wherein said plumbing component comprises a strainer.

22. The system of claim 15, wherein said end piece is an end cap, an o-ring, a flange section, or a pin.

23. A method of installing a plumbing component in a basin, a surface of the basin being secured between a flange of the plumbing component and a face of a lock, the plumbing component having a top section and a bottom section, the top section having the flange and an upper threaded outer surface, the bottom section having a lower threaded outer surface and defining an aperture with one or more retainer bars extending across the aperture to define a plurality of retainer apertures, the method comprising:

providing a first member and a second member, the second member defining an aperture configured to receive the first member therein;

releasably attaching a top end of the first member to the plumbing component with a locking mechanism;

installing the lock onto a top surface of the second member;

placing the second member over the first member to engage the lock with the threaded outer surface of the bottom section; and rotating the second member and the lock to threadedly secure the basin surface between the flange and the lock fall.

24. The method of claim 23, further comprising installing an end piece on a bottom end of the first member that extends beyond the bottom end of the second member, thereby preventing the second member from falling from the bottom end of the first member.

25. The method of claim 23, wherein placing the second member over the first member further comprises inserting the first member through the top end of the second member.

* * * * *